US008770115B2

(12) United States Patent
Apps et al.

(10) Patent No.: US 8,770,115 B2
(45) Date of Patent: Jul. 8, 2014

(54) PALLET ASSEMBLY

(71) Applicant: Rehrig Pacific Company, Los Angeles, CA (US)

(72) Inventors: William P. Apps, Alpharetta, GA (US); Sean T. Ogburn, Hoschton, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/767,855

(22) Filed: Feb. 14, 2013

(65) Prior Publication Data

US 2013/0220184 A1 Aug. 29, 2013

Related U.S. Application Data

(60) Provisional application No. 61/598,886, filed on Feb. 14, 2012.

(51) Int. Cl.
*B65D 19/12* (2006.01)

(52) U.S. Cl.
USPC ..... 108/57.25

(58) Field of Classification Search
USPC ..... 108/51.11, 54.1, 56.1, 56.3, 57.25, 108/57.26
See application file for complete search history.

(56) References Cited

U.S. PATENT DOCUMENTS

| | | | |
|---|---|---|---|
| 2,602,619 | A | 7/1952 | McIntyre |
| 2,699,912 | A | 1/1955 | Cushman |
| 3,664,271 | A | 5/1972 | Wolder et al. |
| 3,680,496 | A | 8/1972 | Westlake, Jr. |
| 4,019,634 | A | 4/1977 | Bonnot |
| 4,487,136 | A | 12/1984 | Beckway |
| 4,597,338 | A | 7/1986 | Kreeger |
| 4,604,014 | A | 8/1986 | Frano |
| 4,606,278 | A | 8/1986 | Shuert |
| 4,735,154 | A | 4/1988 | Hemery |
| 4,850,284 | A | 7/1989 | DeGroot et al. |
| 4,879,956 | A | 11/1989 | Shuert |
| 5,042,396 | A | 8/1991 | Shuert |
| 5,094,175 | A | 3/1992 | Christie |
| 5,289,781 | A | 3/1994 | Beckway |
| 5,367,961 | A | 11/1994 | Arai et al. |
| 5,390,467 | A | 2/1995 | Shuert |
| 5,401,347 | A | 3/1995 | Shuert |
| 5,404,829 | A | 4/1995 | Shuert |

(Continued)

FOREIGN PATENT DOCUMENTS

| | | |
|---|---|---|
| DE | 2125549 | 12/1972 |
| MX | 2008005625 | 3/2009 |

(Continued)

*Primary Examiner* — Matthew Ing
(74) *Attorney, Agent, or Firm* — Carlson, Gaskey & Olds, P.C.

(57) ABSTRACT

A pallet assembly includes an upper portion and a lower portion. The upper portion includes an upper deck for supporting items thereon and upper column portions extending downward from the upper deck. The upper column portions include a first upper column portion having a slot defined by a pair of slot walls. The lower portion includes a plurality of lower column portions including a first lower column portion. The first lower column portion includes a peripheral wall and a support structure having a pair of walls extending inward from the peripheral wall. One of the first upper column portion and the first lower column portion is received within the other, with the support structure received in the slot between the slot walls.

20 Claims, 9 Drawing Sheets

(56) References Cited

U.S. PATENT DOCUMENTS

| | | | | |
|---|---|---|---|---|
| 5,483,899 | A | 1/1996 | Christie | |
| 5,520,120 | A | 5/1996 | Badger | |
| 5,579,686 | A | 12/1996 | Pigott et al. | |
| 5,813,355 | A | 9/1998 | Brown et al. | |
| 5,950,545 | A | 9/1999 | Shuert | |
| 5,996,508 | A | 12/1999 | Constantino et al. | |
| 6,006,677 | A | 12/1999 | Apps et al. | |
| 6,021,721 | A * | 2/2000 | Rushton | 108/56.3 |
| 6,029,583 | A | 2/2000 | LeTrudet | |
| 6,109,190 | A | 8/2000 | Hale et al. | |
| 6,173,659 | B1 * | 1/2001 | Danks et al. | 108/54.1 |
| 6,199,487 | B1 | 3/2001 | Coddington | |
| 6,283,044 | B1 | 9/2001 | Apps | |
| 6,508,182 | B1 | 1/2003 | Smorgan et al. | |
| 6,564,725 | B2 | 5/2003 | Hale | |
| 6,574,934 | B1 | 6/2003 | Queirel | |
| 6,705,237 | B2 | 3/2004 | Moore, Jr. et al. | |
| 6,718,888 | B2 | 4/2004 | Muirhead | |
| 6,742,460 | B2 | 6/2004 | Meyer et al. | |
| 6,805,061 | B2 | 10/2004 | Smyers et al. | |
| 6,807,910 | B2 | 10/2004 | Apps | |
| 6,886,475 | B2 | 5/2005 | Apps et al. | |
| 7,066,340 | B2 | 6/2006 | Robertson | |
| 7,146,773 | B2 | 12/2006 | Wilson | |
| 7,293,509 | B2 * | 11/2007 | Hassell | 108/56.3 |
| 7,342,496 | B2 | 3/2008 | Muirhead | |
| 7,343,865 | B2 | 3/2008 | Shuert | |
| 7,748,329 | B2 | 7/2010 | Baltz | |
| 7,779,763 | B2 | 8/2010 | Valentinsson | |
| 8,141,500 | B2 | 3/2012 | Naidu et al. | |
| 2003/0061974 | A1 | 4/2003 | Smyers | |
| 2003/0075081 | A1 | 4/2003 | Apps | |
| 2003/0136314 | A1 | 7/2003 | Smyers et al. | |
| 2005/0103236 | A1 | 5/2005 | Apps | |
| 2005/0237184 | A1 | 10/2005 | Muirhead | |
| 2007/0062420 | A1 | 3/2007 | Apps et al. | |
| 2008/0017081 | A1 | 1/2008 | Baltz | |
| 2008/0141912 | A1 | 6/2008 | Valentinsson | |
| 2008/0210140 | A1 | 9/2008 | Valentinsson | |
| 2008/0236454 | A1 | 10/2008 | Naidu et al. | |
| 2011/0259249 | A1 * | 10/2011 | Ogburn et al. | 108/57.33 |

FOREIGN PATENT DOCUMENTS

| | | | |
|---|---|---|---|
| WO | 2005118412 | | 12/2005 |
| WO | 2009099314 | | 8/2009 |
| WO | 2010008264 | | 1/2010 |
| WO | WO 2010/003145 | * | 1/2010 |

* cited by examiner

PALLET ASSEMBLY

BACKGROUND

Plastic pallets may include an upper deck and a lower deck (or runners) with columns between the upper deck and the runners to provide openings for receiving the tines of a forklift. The columns and the outer periphery of the upper deck often are impacted by the tines of the forklift. Therefore, the columns and outer periphery of the upper deck suffer most of the damage experienced by plastic pallets.

SUMMARY

A pallet assembly includes an upper portion and a lower portion. The upper portion includes an upper deck for supporting items thereon and upper column portions extending downward from the upper deck. The upper column portions include a first upper column portion having a slot defined by a pair of slot walls. The lower portion includes a plurality of lower column portions including a first lower column portion. The first lower column portion includes a peripheral wall and a support structure having a pair of walls extending inward from the peripheral wall. One of the first upper column portion and the first lower column portion is received within the other, with the support structure received in the slot between the slot walls.

This provides a reinforced column, where substantially the entire height of the column is double-walled.

DETAILED DESCRIPTION OF A PREFERRED EMBODIMENT

Figure 1:
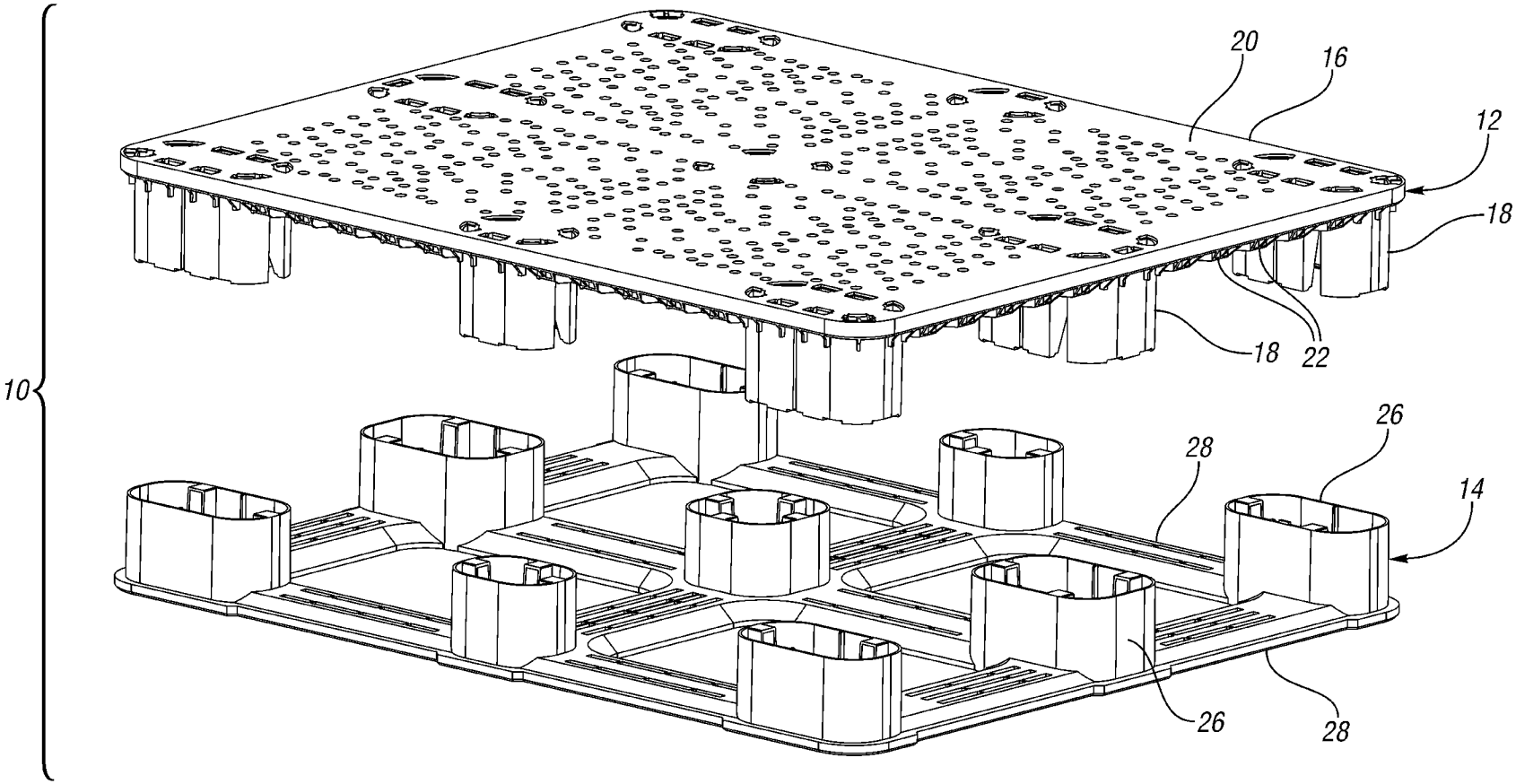
FIG. 1 is an exploded perspective view of a pallet according to one embodiment of the present invention.

A pallet assembly 10 according to a first embodiment is shown in an exploded view in FIG. 1. The pallet assembly 10 includes an upper portion 12 and a lower portion 14, each integrally injection molded as a single piece of plastic, but separately from one another. The upper portion 12 includes an upper deck 16 having an upper surface for supporting goods thereon and upper column portions 18 extending downward from the upper deck 16. The upper deck 16 includes an upper panel portion 20 and ribs 22 extending downward from the upper panel portion 20.

The lower portion 14 of the pallet assembly 10 includes a plurality of lower column portions 26 having runners 28 extending between lower ends thereof.

Figure 2:
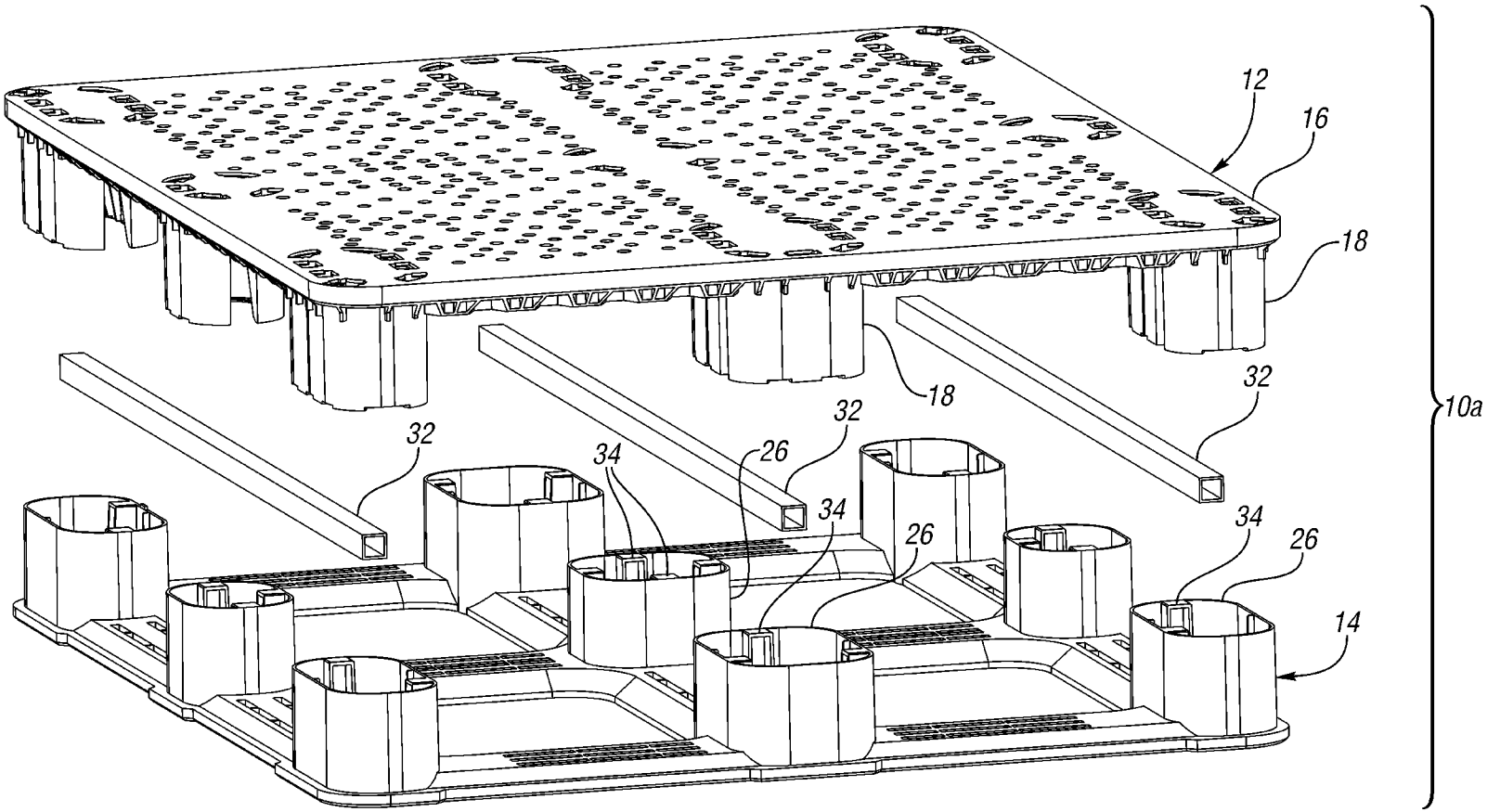
FIG. 2 shows the pallet of FIG. 1 with optional lateral reinforcement members.

Referring to FIG. 2, the pallet assembly 10 of FIG. 1 can optionally be configured (shown as pallet assembly 10*a*) with lateral reinforcement members 32 extending parallel to the short side of the pallet assembly 10*a*. The lateral reinforcement members 32 are aligned with lateral support structures 34 formed in the lower column portions 26. The lateral reinforcement members 32 would be captured within the upper column portions 18 and between the upper deck 16 and the lower column portions 26.

Figure 3:
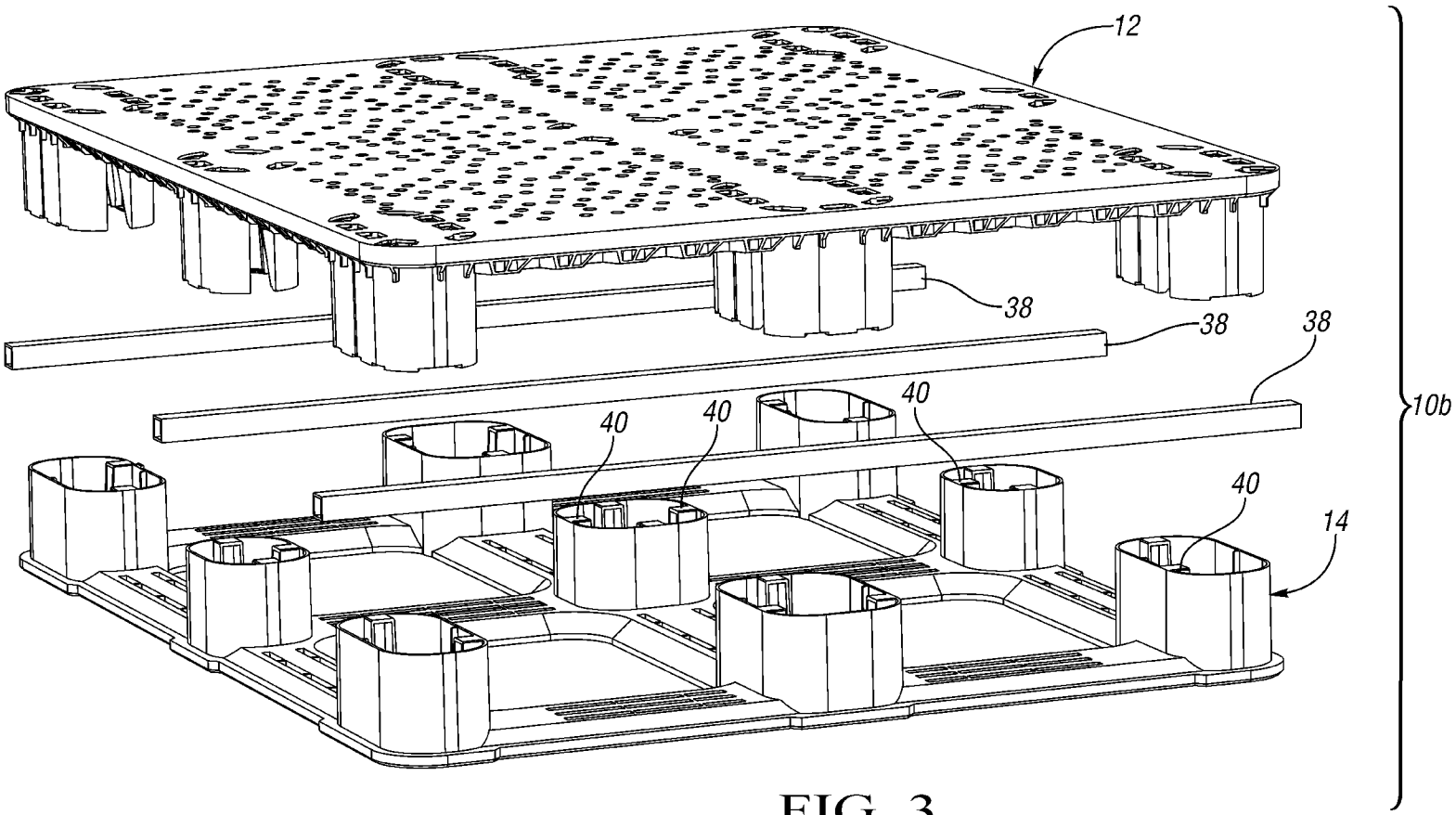
FIG. 3 shows the pallet of FIG. 1 with optional longitudinal reinforcement members.

Referring to FIG. 3, the pallet assembly 10 of FIG. 1 can also optionally be configured (shown as pallet assembly 10*b*) with longitudinal reinforcement members 38 extending parallel to the long side of the pallet assembly 10*a*. The reinforcement members 38 are aligned with longitudinal support structures 40 formed in the lower column portions 26. The reinforcement members 38 would be captured within the upper column portions 18 and between the upper deck 16 and the lower column portions 26. The reinforcement members 32, 38 could be metal, steel, aluminum, fiberglass or other stiff, stronger material. Although rectangular or square cross sections are shown, I-beam or other cross sections could also be used.

Figure 4:
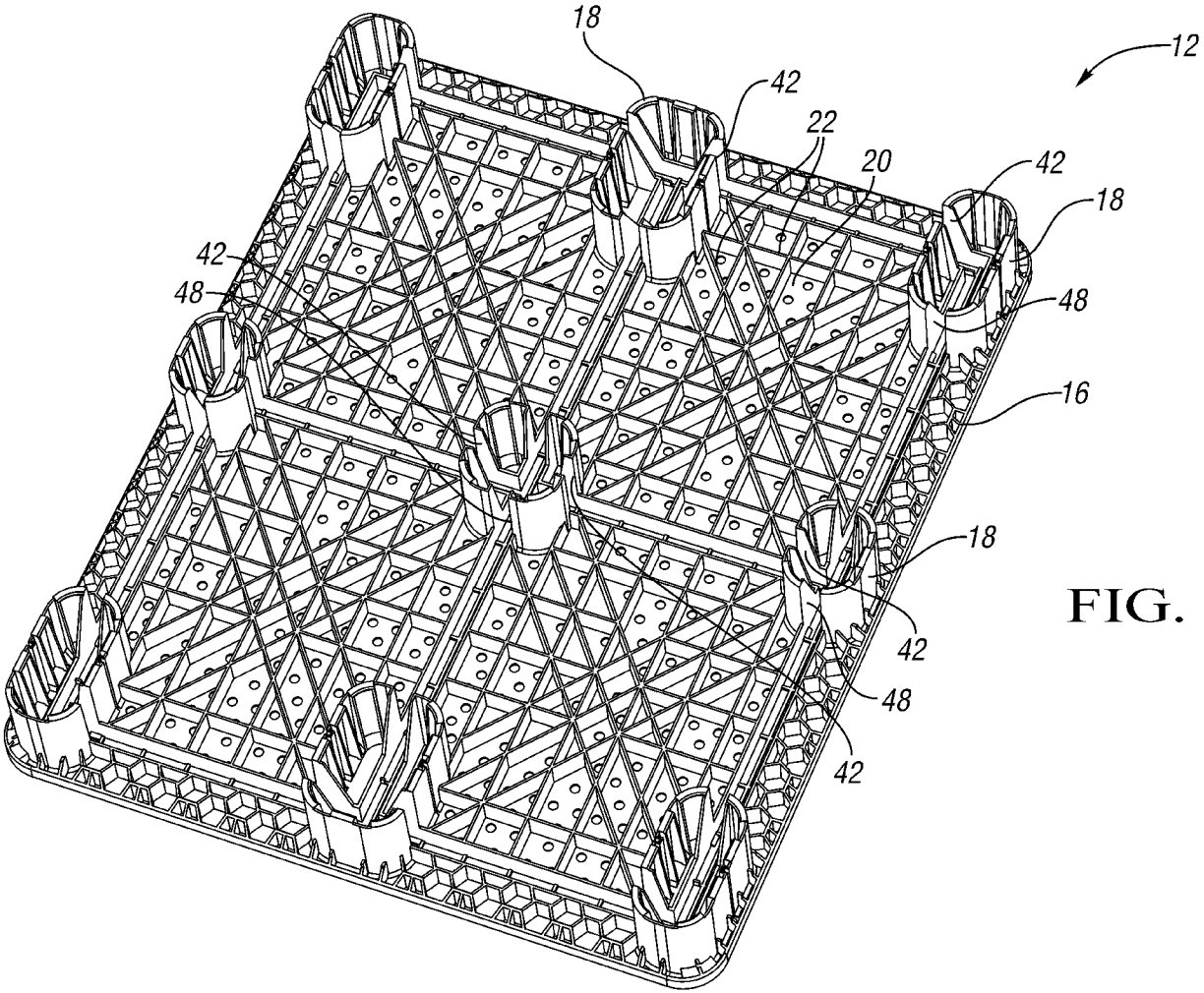
FIG. 4 is a bottom perspective view of the top deck of the pallet of FIG. 1.

FIG. 4 is a bottom perspective view of the upper portion 12. Each upper column portion 18 includes lateral slots 42 for accommodating the lateral reinforcement members 32 (FIG. 2) and longitudinal slots 48 for accommodating the longitudinal reinforcement members 38 (FIG. 3).

Figure 5:
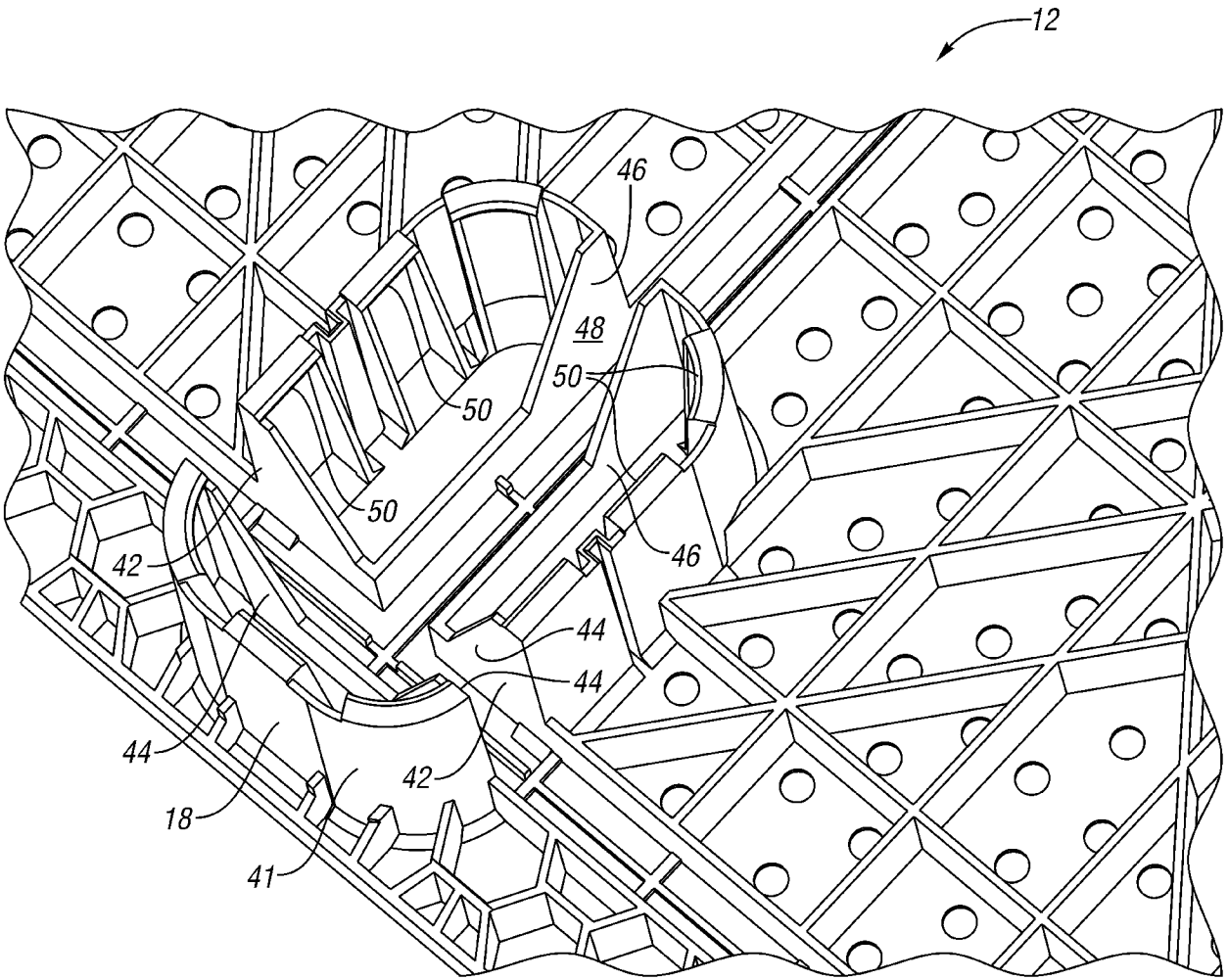
FIG. 5 is an enlarged view of one of the upper column portions of FIG. 4.

FIG. 5 is an enlarged view of one of the upper column portions 18 of FIG. 4. The upper column portion 18 includes a peripheral wall 41. Parallel lateral walls 44 extend inward from the peripheral wall 41 and define the lateral slots 42 and parallel longitudinal walls 46 defining the longitudinal slots 48. Snap receivers 50 are formed at the lower end of the peripheral wall of upper column portion 18, such as in the form shown, of an inward-protruding tab.

Figure 6:
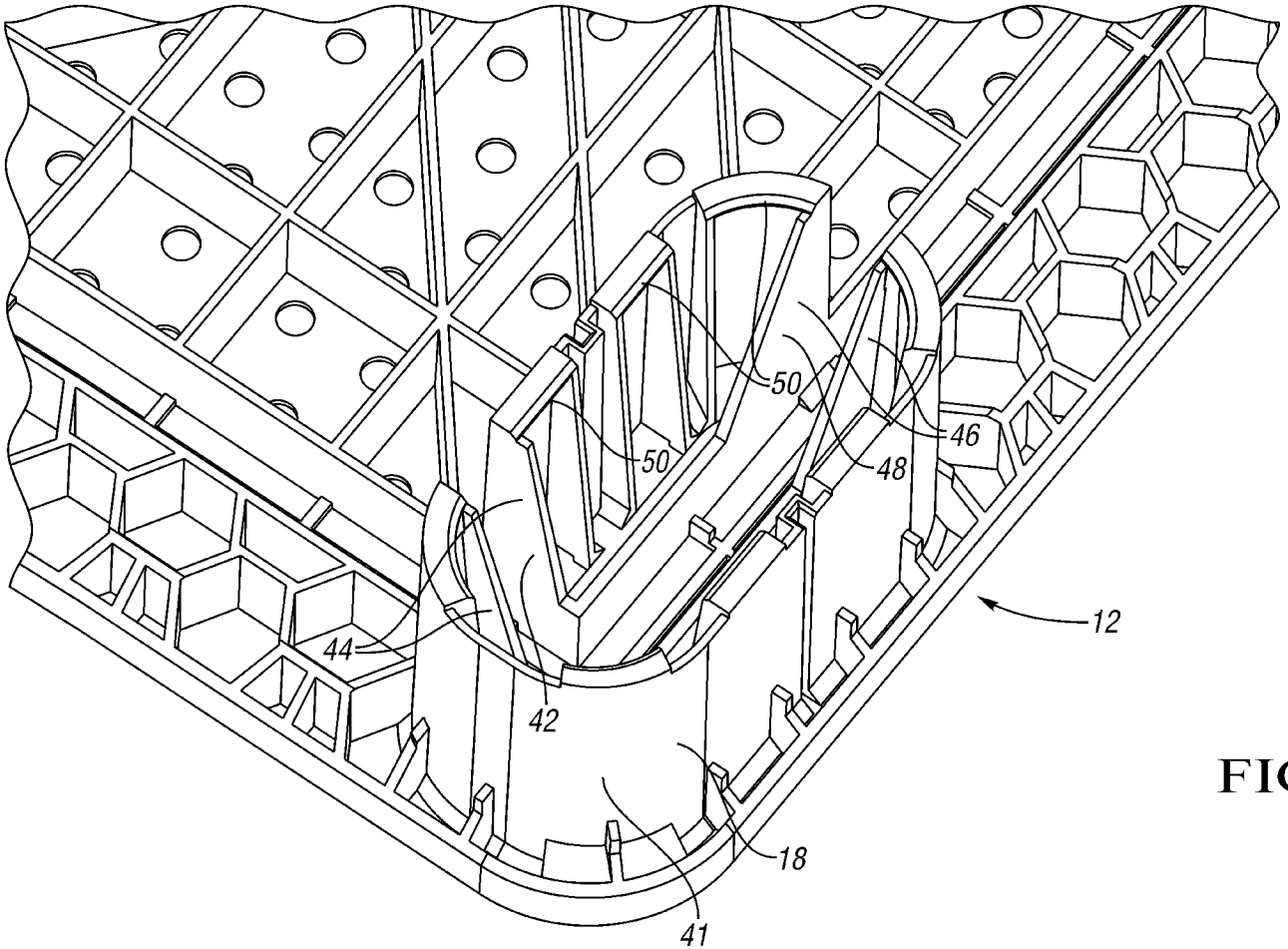
FIG. 6 is an enlarged view of a corner upper column portion of FIG. 4.

FIG. 6 is an enlarged view of a corner upper column portion 18 of FIG. 4. The corner upper column portion 18 includes lateral slots 42 defined by the lateral walls 44 and longitudinal slots 48 defined by the longitudinal walls 46. Snap receivers 50 are formed at the lower end of the peripheral wall 41 of upper column portion 18.

Figure 7:
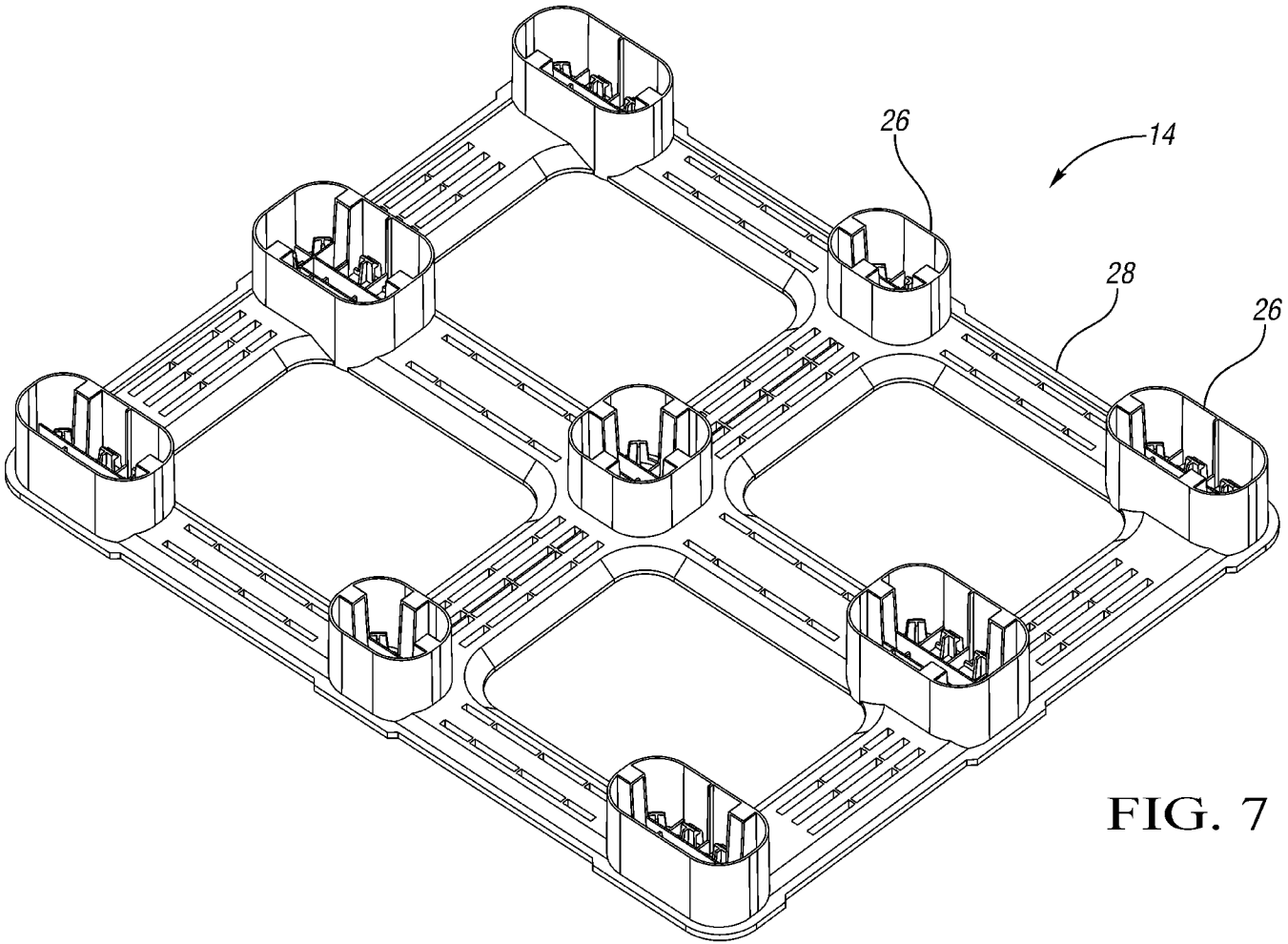
FIG. 7 is a perspective view of the lower portion.

FIG. 7 is a perspective view of the lower portion 14. The lower portion 14 includes lower column portions 26 having runners 28 extending between the lower ends of the lower column portions 26.

Figure 8:
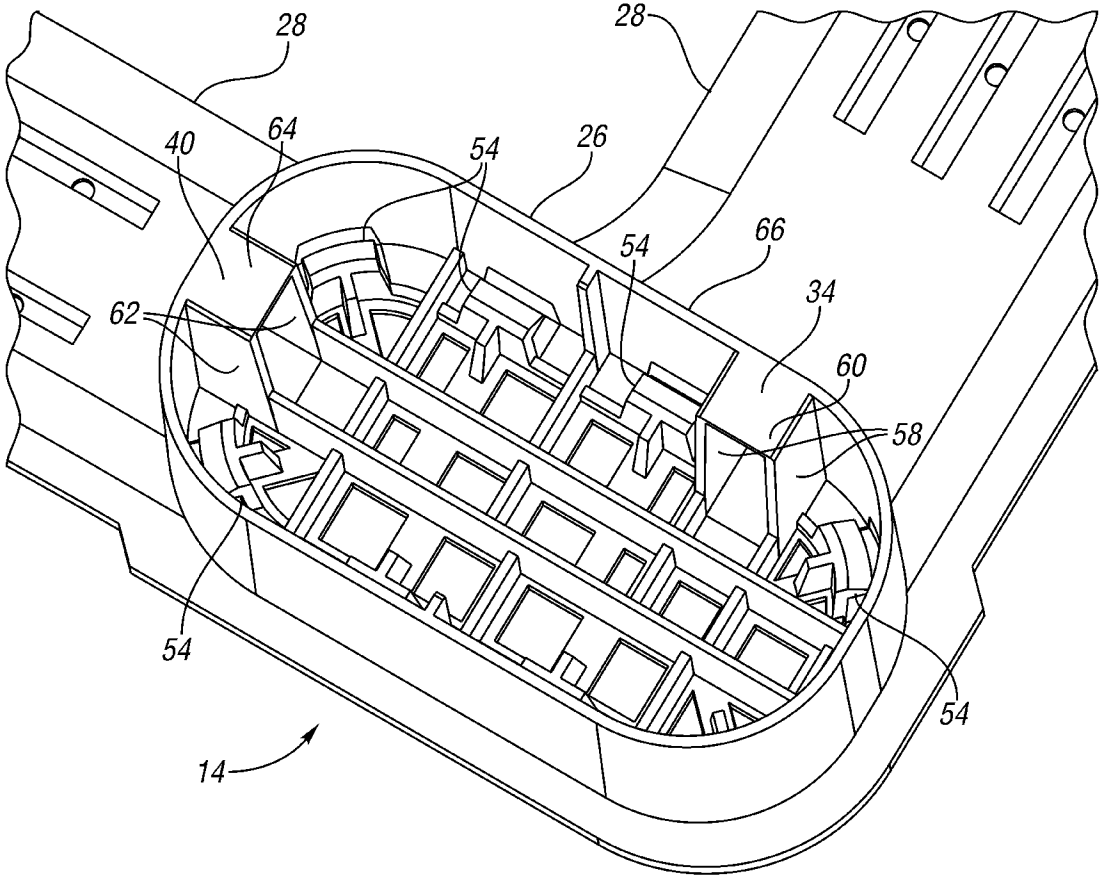
FIG. 8 is an enlarged view of one of the lower column portions of FIG. 7.

FIG. 8 is an enlarged view of one of the lower column portions 26 of FIG. 7. As shown, the lateral support structures 34 include two vertical ribs 58 protruding inward from the peripheral wall 66 of the lower column portion 26 and an upper wall 60 connecting the upper ends of the vertical ribs 58. The longitudinal support structures 40 include two vertical ribs 62 protruding inward from the peripheral wall 66 and an upper wall 64 connecting the upper ends of the vertical ribs 62. A plurality of snap-tabs 54 are formed at the lower end of the lower column portion 26, spaced inward from the peripheral wall 66 of the lower column portion 26.

Figure 9:
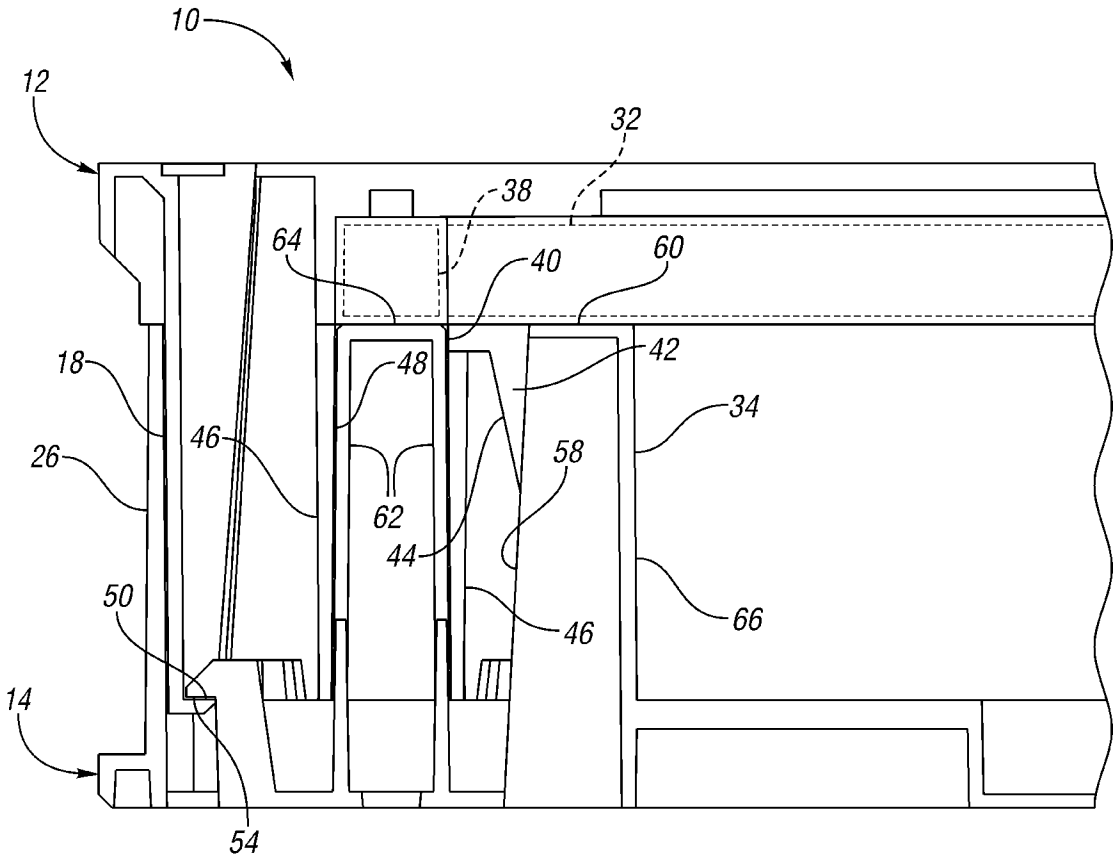
FIG. 9 is a section view through an assembled column of the pallet assembly 10.

FIG. 9 is a section view through an assembled column of the pallet assembly 10. The upper column portion 18 is received within lower column portion 26 to provide a double-wall throughout substantially the entire height of the column and to provide a reinforced column. Alternatively, the double-wall could be provided for the entire height of the column.

The snap-tabs 54 snap connect to the snap receivers 50 to connect the upper portion 12 to the lower portion 14. The lateral support structures 34 are received in the lateral slots 42 between the lateral walls 44, leaving space in each lateral slot 42 above the lateral support structure 34 for the lateral reinforcement member 32 (shown in phantom). The lateral support structure 34 is reinforced by the lateral walls 44. The longitudinal support structures 40 are received in the longitudinal slots 48 between the longitudinal walls 46, leaving space in each longitudinal slot 48 above the longitudinal support structure 40 for the longitudinal reinforcement member 38 (shown in phantom). The longitudinal support structure 40 is reinforced by the longitudinal walls 46.

The pallet assembly 10*a* would be assembled identically, but with the reinforcement members 32 (shown in phantom in FIG. 9) received in the lateral slots 42 of the upper column portions 18 and supported on the lateral support structures 34 of the lower portion 14 to transfer weight from the upper deck 16 through the reinforcement members 32 to the lateral support structures 34 and the lower column portions 26.

The pallet assembly 10*b* would be assembled identically, but with the reinforcement members 38 (shown in phantom in FIG. 9) received in the longitudinal slots 48 of the upper column portions 18 and supported on the longitudinal support structures 40 of the lower portion 14 to transfer weight from the upper deck 16 through the reinforcement members 38 to the longitudinal support structures 40 and the lower column portions 26.

Alternatively, the pallet assembly 10 could be used with both lateral reinforcement members 32 and the longitudinal reinforcement members 38. As another option, the lateral reinforcement members 32 could be welded or otherwise secured to the longitudinal reinforcement members 38. Alternatively, only the two outermost lateral reinforcement members 32 and the longitudinal reinforcement members 38 are used and connected together, with a single lateral reinforcement member 32 or a single longitudinal reinforcement member 38 welded in between.

As shown, the pallet assembly 10 provides several optional configurations regarding reinforcement. The pallet assembly 10 provides columns reinforced by double-wall thickness, with the optionally-used slots 42, 48 mostly hidden within the lower column portions 26.

The upper portion 12 and lower portion 14 are each integrally injection molded as a single piece of plastic, such as HDPE, polypropylene or other suitable material.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pallet assembly comprising:

an upper portion including an upper deck for supporting items thereon and upper column portions extending downward from the upper deck, the upper column portions including a first upper column portion having a slot defined by slot walls; and a lower portion including a plurality of lower column portions including a first lower column portion, the first lower column portion including a peripheral wall and a support structure having a pair of walls extending inward from the peripheral wall, one of the first upper column portion and the first lower column portion received within the other, the support structure received in the slot between the slot walls.

2. The pallet assembly of claim 1 further including a reinforcement member received in the slot in the first upper column portion above the support structure in the first lower column portion.

3. The pallet assembly of claim 2 wherein the support structure is the same height as the peripheral wall of the first lower column portion.

4. The pallet assembly of claim 1 wherein the first upper column portion is received within the first lower column portion.

5. The pallet assembly of claim 1 wherein the first upper column portion is snap-fit connected to the first lower column portion.

6. The pallet assembly of claim 1 wherein the slot in the first upper column portion is a lateral slot and the support structure in the first lower column portion is a lateral support structure, the first upper column portion further including a longitudinal slot extending through the first upper column portion in a direction generally perpendicular to the lateral slot, the first lower column portion further including a longitudinal support structure including a pair of walls extending from the peripheral wall, the longitudinal support structure received in the longitudinal slot.

7. The pallet assembly of claim 1 further including an upper wall extending across the pair of walls of the support structure.

8. The pallet assembly of claim 1 further including a plurality of runners connecting lower ends of the plurality of lower column portions.

9. The pallet assembly of claim 1 wherein the slot walls extend inward from a periphery of the first upper column portion.

10. The pallet assembly of claim 1 wherein the slot walls are generally parallel to one another and generally transverse to an upper peripheral wall of the first upper column portion.

11. The pallet assembly of claim 1 wherein the support structure is spaced away from an upper edge of the slot in which the support structure is received.

12. The pallet assembly of claim 1 wherein the peripheral wall of the first lower column portion extends between the pair of walls of the support structure.

13. A pallet assembly comprising:

an upper portion including an upper deck for supporting items thereon and a plurality of upper column portions extending downward from the upper deck, the plurality of upper column portions each having a slot defined by slot walls; and a lower portion including a plurality of lower column portions each including a peripheral wall and a support structure having a pair of walls extending inward from the peripheral wall, each of the plurality of upper column portions received within one of the plurality of lower column portions, with the support structure of each lower column portion received in the slot between the slot walls of the respective upper column portion.

14. The pallet assembly of claim 13 further including a reinforcement member received in the slots in the plurality of upper column portions above the support structures in the plurality of lower column portions.

15. The pallet assembly of claim 14 wherein the plurality of upper column portions are snap-fit connected to the plurality of lower column portions.

16. The pallet assembly of claim 13 wherein the slot in each of the plurality of upper column portions is a lateral slot and the support structure in each of the plurality of lower column portions is a lateral support structure, each of the plurality of upper column portions further including a longitudinal slot extending through the upper column portion in a direction generally perpendicular to the lateral slot, each of the plurality of lower column portions further including a longitudinal support structure including a pair of walls extending from the peripheral wall of the lower column portion, the longitudinal support structure of each of the plurality of lower column portions received in the longitudinal slot of the respective one of the of the plurality of upper column portions.

17. The pallet assembly of claim 13 further including an upper wall extending across the pair of walls of the support structure.

18. A pallet assembly comprising:

an upper portion including an upper deck for supporting items thereon and a plurality of upper column portions extending downward from the upper deck, the plurality of upper column portions each having a slot defined by slot walls;

a lower portion including a plurality of lower column portions each including a peripheral wall and a support structure having a pair of walls extending inward from the peripheral wall and an upper wall extending across the pair of walls of the support structure, each of the plurality of upper column portions received within one of the plurality of lower column portions, with the support structure of each lower column portion received in the slot between the slot walls of the respective upper column portion; and a reinforcement member received in the slots in the plurality of upper column portions above upper walls of the support structures in the plurality of lower column portions.

19. The pallet assembly of claim 18 wherein the slot walls extend inward from a periphery of the first upper column portion.

20. The pallet assembly of claim 18 wherein the slot walls are generally parallel to one another and generally transverse to an upper peripheral wall of the first upper column portion.

* * * * *